United States Patent [19]

Upchurch

[11] Patent Number: 4,993,180

[45] Date of Patent: Feb. 19, 1991

[54] MAGAZINE LOADING ASSISTANCE APPARATUS

[76] Inventor: Lewis E. Upchurch, 2381 Gulf To Bay Mobile Home Park, Lot #702, Clearwater, Fla. 34625

[21] Appl. No.: 289,223

[22] Filed: Dec. 23, 1988

[51] Int. Cl.[5] ..... F41A 9/83

[52] U.S. Cl. ..... 42/87

[58] Field of Search ..... 42/87, 90

[56] References Cited

U.S. PATENT DOCUMENTS

| | | | |
|---|---|---|---|
| 2,137,491 | 11/1938 | Huff | 42/87 |
| 2,862,324 | 12/1958 | Ball | 42/87 |
| 4,413,437 | 11/1983 | Anderson | 42/50 |
| 4,446,645 | 5/1984 | Kelsey, Jr. et al. | 42/50 |
| 4,452,002 | 6/1984 | Musgrave | 42/87 |
| 4,464,855 | 8/1984 | Musgrave | 42/87 |
| 4,570,371 | 2/1986 | Mears | 42/87 |
| 4,689,909 | 9/1987 | Howard | 42/87 |
| 4,719,715 | 1/1988 | Howard | 42/87 |
| 4,827,651 | 5/1989 | Conkey | 42/87 |
| 4,829,693 | 5/1989 | Holmes | 42/87 |

*Primary Examiner*—Charles T. Jordan
*Attorney, Agent, or Firm*—Charles E. Lykes, Jr.

[57] ABSTRACT

An apparatus for assisting a marksman in loading ammunition into a magazine or clip generally comprising a rectangular sleeve which is adapted with an interior plunging member and an exterior serrated gripping surface.

2 Claims, 3 Drawing Sheets

MAGAZINE LOADING ASSISTANCE APPARATUS

BACKGROUND OF THE INVENTION

The invention relates to accessories to firearms, particularly such accessories as will assist a marksman in the loading in an ammunition loading bearing magazine with ammunition.

Many small arms, including both rifles and handguns, are in the category known as magazine or clip fed. In these firearms, ammunition is placed into an elongated, generally rectangular cross-sectioned container known as a magazine or clip which is then fitted into a portion of the firearm approximate to the firing chamber. The magazine or clip is closed on five sides and open on a rectangular shaped end. Such magazines or clips are spring loaded and further adapted with retaining members over the open end. Ammunition is then slipped into the open end of the magazine, piece by piece, and each piece slips past the retaining member to be held until used. As the magazine is being loaded each succeeding round of ammunition compresses the spring further and becomes harder to insert.

When the magazine is fully loaded it is fitted into a position adjacent to or fitted against the firing chamber of the weapon. Normally a bolt is used to extract a round and force it into the firing chamber. As each round is fired the bolt is forced back, picks up the next round, and forces the next round into the firing chamber. The force of the spring pushes each round up into a position of the magazine where the bolt can push it into the firing chamber.

It can readily be seen that the task of loading successive rounds of ammunition into a magazine is one which requires some care and manual dexterity. This is particularly true on cold days when a person's fingers are numb, or are enclosed in a glove or mitten, in a situation (such as military combat) when speed in reloading may be of the essence.

A number of devices exists which are adapted to assist the marksman in accomplishing this task. In particular U.S. Pat. No. 4,446,645 issued to Kelsey on May 8, 1984, U S. Pat. No. 4,413,437 issued to Anderson on Nov. 8, 1983, and U.S. Pat. No. 4,452,002 issued to Musgrave, on June 5, 1984, describe various forms of magazines which are adapted for easy loading. Each of these inventions is designed to provide a more satisfactory form of ammunition magazine or clip but do not realistically solve the problems encountered by fitting a round of ammunition into the magazine or cartridge opening.

U.S. Pat. No. 4,464,855, issued to Musgrave on Aug. 14, 1984, teaches a device somewhat useful in solving the above described problem. It teaches a slidably attached apparatus which is adapted with a pulling handle and a protrusion which is adapted to push a round of ammunition down into the magazine for insertion of the next round. After each successive round of ammunition is loaded into the magazine the apparatus must be removed from the magazine and reinserted for the next round. While it does facilitate in solving this problem, the requirement of removal and reinsertion makes its use somewhat tedious.

U.S. Pat. No. 4,689,909, issued to Howard on Sept. 1, 1987, teaches a device which can he fitted over an ammunition magazine. It is adapted with a spring loaded plunger which, when the device is fitted over the magazine and somehow held in place, is used to push the uppermost round down into the magazine to facilitate sliding in the next round. Then the plunger, which is spring loaded, is depressed and the cartridge is fitted all the way into the back of the magazine. Howard is also somewhat helpful, but difficulties may be encountered in holding the device in place against the magazine. It should also be noted that both Howard and Musgrave are, because of their structure, primarily useful only in magazines over a narrow range of sizes.

What is missing in the prior art is such a device which can be used on a variety of magazine sizes and types, which permits the plunging task to be repeatedly and continuously performed with one hand, and which comprises no moving parts.

SUMMARY OF THE INVENTION

The present invention is adapted to satisfy the needs described above. It comprises an elongated hollow rectangular shaped casing which is open at one rectangular end and substantially open, except for a plunging mechanism, at the other rectangular end. It further comprises one or more serrated surfaces to assist the marksman in gripping the device for loading the magazine or clip.

It is an object of the invention to provide an apparatus useful in assisting a marksman in quickly and easily loading an ammunition magazine or clip.

It is another object of the invention to provide such a magazine or clip loading apparatus which is useful with a variety of sizes and types of ammunition magazines or clips.

It is a further object of the invention to provide such an magazine or clip loading apparatus which may be easily used in very cold weather when a marksman's fingers are adversely affected by the effects of chill or when the marksman is required to wear gloves or mittens Other features and advantages of the present invention will be apparent from the following description in which the preferred embodiments have been set forth in conjunction with the accompanying drawings.

DETAILED DESCRIPTION OF THE PREFERRED EMBODIMENT

In describing the preferred embodiment of the invention reference will be made to the figures briefly described above. The apparatus will first be described with respect to its structure and then the use of the preferred embodiment will be detailed.

Figure 1:
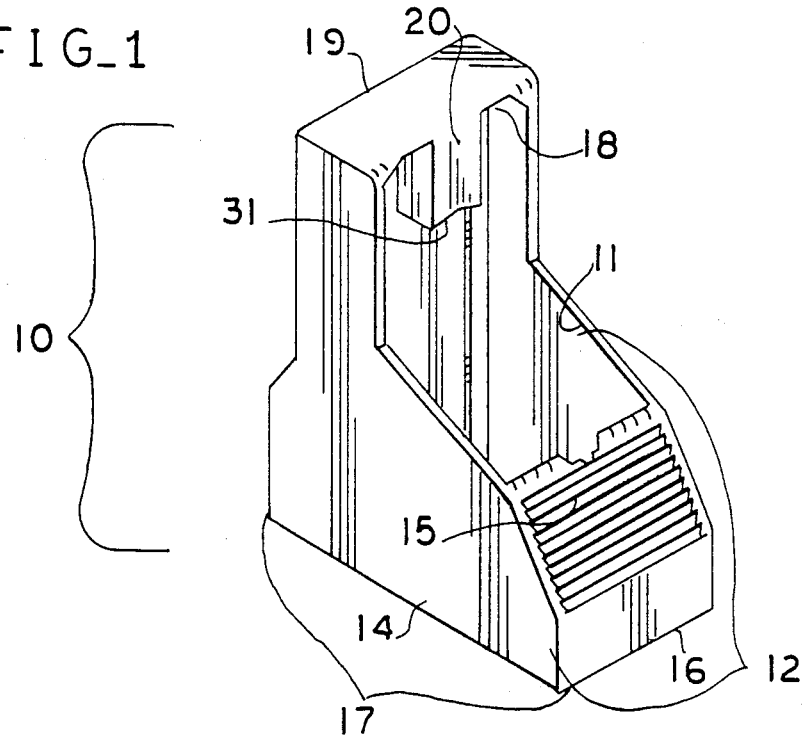
FIG. 1 is an oblique view of the apparatus permitting the display of each major component.

Making reference first to FIG. 1 the general structure of the device will be described. The preferred embodiment of the invention generally comprises an elongated rectangular structure generally (10) which is substantially hollowed out, said hollowed out area (11) also generally being an elongated and of rectangular cross section (12). The outside surface (14) of the elongated rectangular member (11) is adapted with at least one serrated area (15). The serrated area appears on an end (16) of one of the two narrow sides (17). Extending from the inner surface (18) of the opposite narrow side

(17) at the opposite end (19) of the apparatus (10) generally extends a short rigid protrusion (20), which could have a concave lower surface (31).

Figure 2:
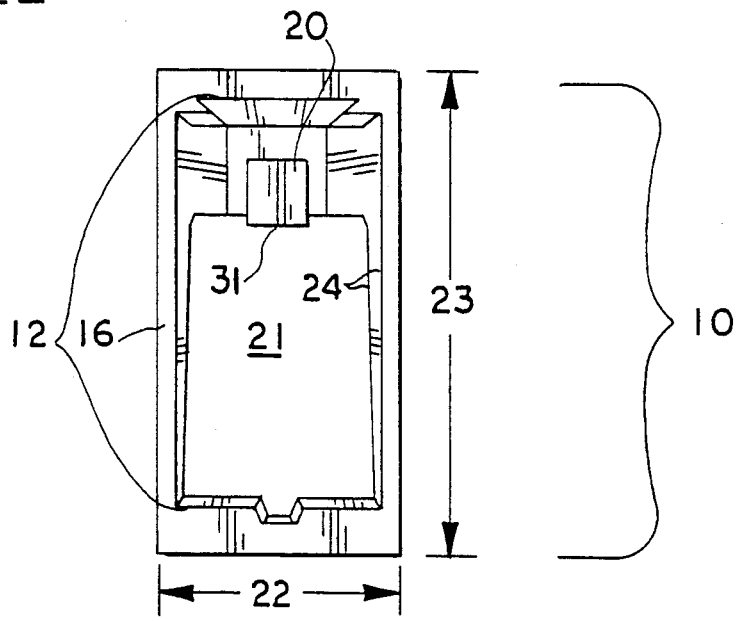
FIG. 2 is a bottom view of the apparatus.

Reference will now be made to FIG. 2 which is a view of the lower end (16) of the apparatus (10). From the view of the apparatus (10) afforded by FIG. 2, it can been seen that said apparatus (10) includes a rectangular opening (21) at its bottom end (16). The dimensions (22, 23) of this opening should be sufficient to permit the insertion of an ammunition magazine or clip (not depicted in FIG. 2). Furthermore, the hollowed area (12) should be of adequate dimensions throughout its length (24) to permit such an ammunition magazine or casing to slide freely throughout the apparatus (10) until making contact with the short and rigid protrusion (20).

At this point it is appropriate to make some comments regarding these dimensions (22, 23).

Ammunition magazines and clips for such small arms come in a variety of sizes in order to accommodate a variety of weapons and ammunition types. The apparatus as taught in the present embodiment can be made of any dimensions desired. There may be certain dimensions which are suitable for operation with a variety of different ammunition magazines and clips. There may also be situations however when it is only appropriate to manufacture such an apparatus for application to a specific ammunition or clip. In such cases these dimensions (22, 23) should be made to allow only a small gap between the interior surface (18) of the apparatus (10) and the specific ammunition magazine or clip in use.

Figure 3:
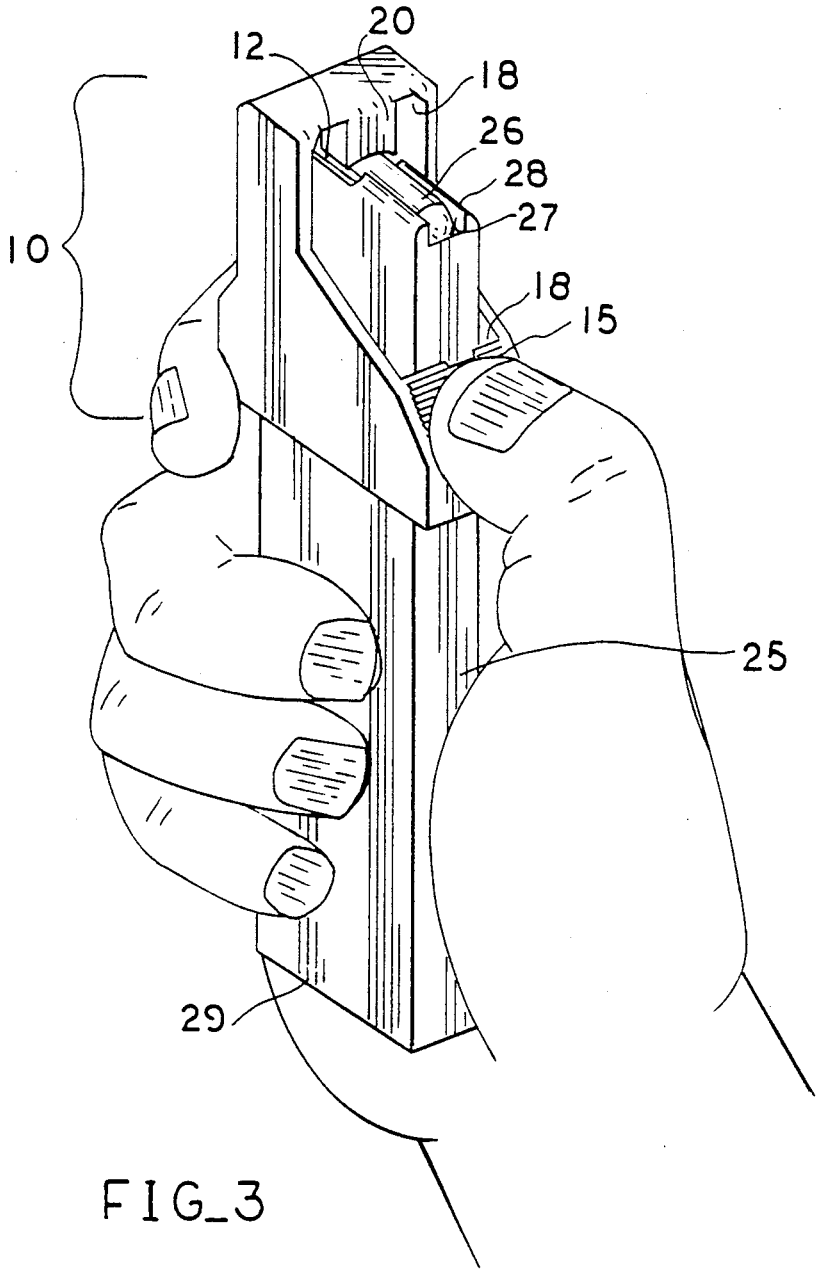
FIG. 3 is an oblique view of the apparatus at the beginning of use.

Reference will now be made to FIG. 3 which is a depiction of the apparatus (10) in place over an ammunition magazine or clip (25) into which one or more rounds of ammunition (26) have been loaded. As shown, a magazine or clip (25) has been inserted through the apparatus (10) until a round of ammunition (26) makes contact with the rigid protrusion (20). It can been seen that such a magazine or clip (25) has a generally open end (27) to permit the insertion and removal of a round of ammunition (26). Said open end (27) is further adapted with a retaining member 28) which is positioned so as to hold a round of ammunition (26) in place for extraction from the magazine or clip (25) and insertion into the firing chamber of the weapon (not depicted). At the lower end (29) of the magazine (25) (within the magazine and not depicted here) exists a spring which serves to push each successive round of ammunition (26) to the retaining member (28) for such extraction.

In order to load a round of ammunition (26) into the open end (27) of the magazine (25) it is necessary to push the uppermost round of ammunition (26) down into the magazine (25) and slide another round of ammunition (26) in between the retaining member (28) and the present uppermost round of ammunition (26). Assistance with this task is the purpose of the present invention.

Figure 4:
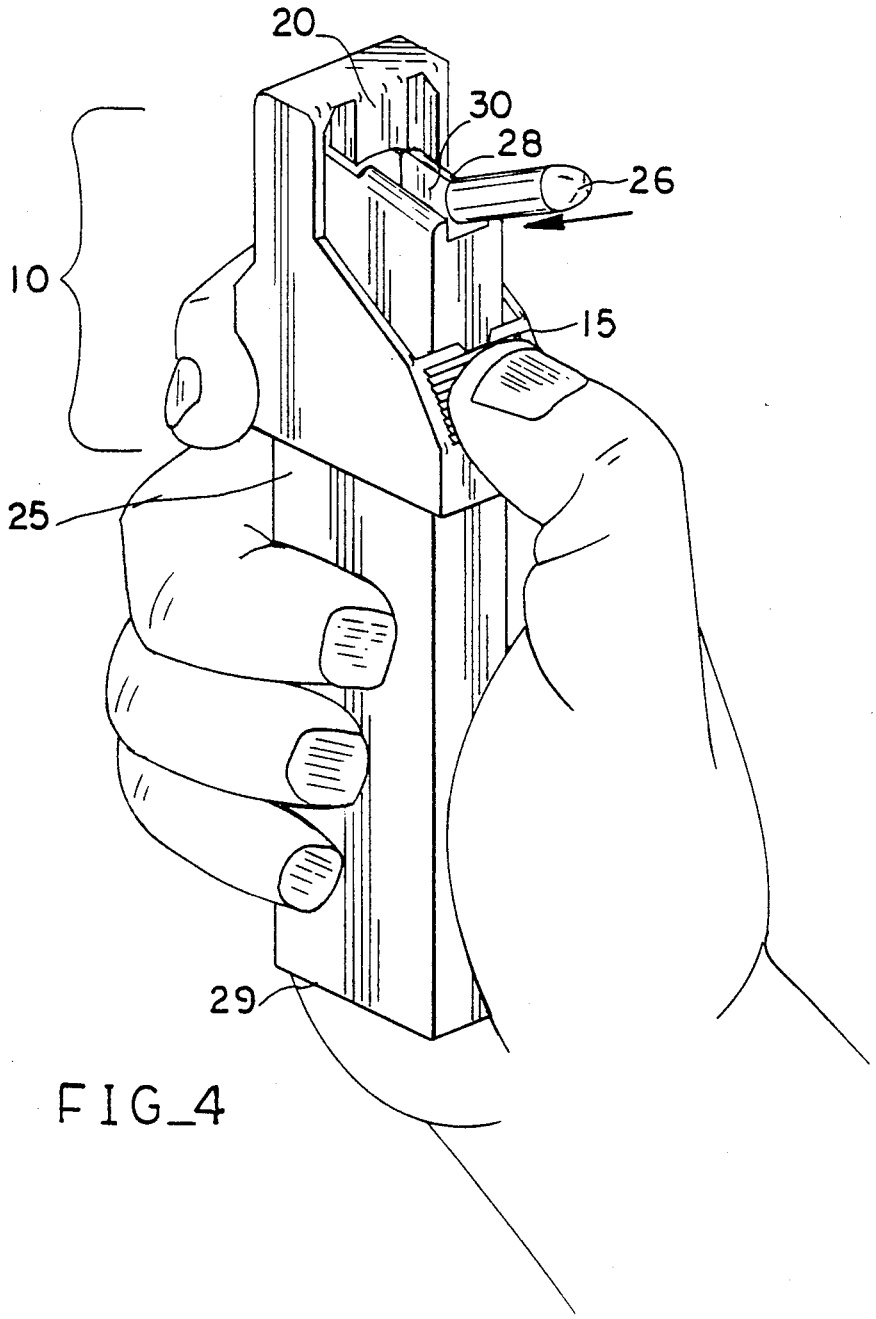
FIG. 4 is an oblique view of the apparatus during use.

From the position depicted in FIG. 4, it can be seen that by putting pressure with one's finger or thumb against the serrated area (15) of the outer surface of the apparatus (10) the rigid protrusion (20) will force the uppermost round of ammunition along with the rigid protrusion (20) down into the interior of the magazine (generally 30). A new round of ammunition (26) can than be easily slid into the space between the retaining member (28) of the magazine (25) and the present uppermost round of ammunition (26) in the magazine (25). This operation is depicted in FIG. 4.

Without such an apparatus (10), a person would normally be required to use a finger or thumb to push to most uppermost round (26) out of the way and hold such round (26) in place while the next round is slipped into position. Not only does such a task require the full use of two hands but also requires substantial dexterity and strength of the hand responsible for pushing and holding the present uppermost round (26) into position. This task is particularly hard when the weather is cold as fingers either experience considerable discomfort or the person loading the ammunition is wearing gloves or mittens, making this task difficult from the standpoint from required dexterity.

After each successive round of ammunition (26) is loaded into the magazine (25) this process can be repeated as many times as necessary to fill the magazine (25) to capacity with rounds of ammunition (26). As each successive round of ammunition (26) is loaded into the magazine (25) it should also be noted that this task becomes more and more difficult as the tension on the spring at the spring (not depicted) at the lower end of the magazine (29) becomes more tense and difficult to operate.

It should be noted that the invention can be made to fit a particular sized ammunition magazine or clip. It can also be made to fit all the various sized ammunition magazines or clips of a given claibre. It can further be made to fit (or work in conjunction with) a number of different sized ammunition magazines or clips within a reasonable range of sizes.

Certain other modifications of the invention are clearly possible which do not depart from the true spirit of the invention. For instance, the serrated area (15) is described as being on the side opposite from the rigid protrusion (20). Such serrated surface however could easily be placed on any exterior surface of the apparatus, including the larger sides adjacent to the broad sides of the magazine. Such a serrated surface would be useful at any point along the exterior surface in keeping with the needs of an individual marksman. Additionally, a shell apparatus could be adapted with an overall hollowed out area large enough to accommodate virtually any sized ammunition magazine or clip, but then equipped with one or more interchangeable and removable rigid protrusions to enable such a shell to be used with a variety of ammunition calibres and lengths.

Modification and variation can be made to the disclosed embodiments without departing from the subject and spirit of the invention as defined in the following claims. Such modifications and variations, as included within the scope of these claims, are meant to be considered part of the invention as described.

What is claimed is:

1. An apparatus useful in assisting a person in loading ammunition into an ammunition magazine or clip, said apparatus comprising;

a generally rectangular and hollow shell with one completely open lower end and an upper end;

said hollow portion of said shell being of generally rectangular cross-section and of adequate size to permit a particular ammunition magazine or clip to be slidably inserted and guided with a narrow range of precision;

said interior hollow portion being adapted at one end with a rigid plunging member, said plunging member extending substantially over said upper end from one of said narrow rectangular sides and being further adapted with a plunging shaft, said plunging shaft extending a distance down into the interior of said hollowed upper end adequate to engage and plunge a round of ammunition therein; and the exterior surface of said apparatus being adapted with at least one serrated area sufficiently large for a person's finger to make firm contact therewith.

2. The invention described in claim 1 in which said plunging shaft is further adapted with a slightly concave lower surface so as to make secure contact with a round of ammunition.

* * * * *